US005780122A

United States Patent [19]

Shirahata et al.

[11] Patent Number: 5,780,122

[45] Date of Patent: Jul. 14, 1998

[54] PRETREATMENT METHOD FOR COATING ON MOLDED METAL ARTICLE

[75] Inventors: Seiichiro Shirahata, Toyonaka, Japan; Mitsuo Shinomiya, Canton, Mich.; Satoshi Miyamoto, Toyonaka; Tamotsu Sobata, Ibaraki, both of Japan

[73] Assignee: Nippon Paint Co., Ltd., Osaka, Japan

[21] Appl. No.: 760,459

[22] Filed: Dec. 6, 1996

[30] Foreign Application Priority Data

Dec. 12, 1995 [JP] Japan ..... 7-322826
Oct. 25, 1996 [JP] Japan ..... 8-283699

[51] Int. Cl.[6] ..... B06B 1/20

[52] U.S. Cl. ..... 427/601; 427/435; 427/443.2; 427/444; 427/560

[58] Field of Search ..... 427/560, 601, 427/444, 435, 443.2

[56] References Cited

U.S. PATENT DOCUMENTS 4,101,386 7/1978 Dotzer et al. ..... 204/32 R

FOREIGN PATENT DOCUMENTS 114087A 7/1984 European Pat. Off. .
443513A 12/1979 France .
743357A 11/1986 Japan .
021649A 12/1979 United Kingdom .

OTHER PUBLICATIONS

Patent Abstracts of Japan, vol. 016, No. 086(C-0916), 3 Mar. 1992 & JP03 275130A.
Galvanotechnik, vol. 76, No. 11, 1 Nov. 1985 & SU1 070 212A.
Patent Abstracts of Japan, vol. 096, No. 12, 26 Dec. 1996 & JP08 218180A.
Patent Abstracts of Japan, vol. 010, No. 139(C-348), 22 May 1986 & JP61 000582A.
Database WPI, Section Ch, Week 7920 & JP54 045 639a (no date avail.).

*Primary Examiner*—Bernard Pianalto
*Attorney, Agent, or Firm*—Townsend & Banta

[57] ABSTRACT

A solution which is stored in a treatment bath is stirred by vibration stirring means provided in the treatment bath in a range of receiving a metal molded article or around a substantially horizontal surface of the metal molded article so that mean acceleration a expressed in the following equation is at least 8 cm/sec$^2$:

$$\alpha = \sqrt{X^2 + Y^2 + Z^2}$$

where X, Y and Z, which are in units of cm/sec$^2$, represent average acceleration values of flow rate changes within 60 seconds, measured simultaneously in three axial directions of X, Y and Z which are perpendicular to each other at a measuring position.

13 Claims, 6 Drawing Sheets

PRETREATMENT METHOD FOR COATING ON MOLDED METAL ARTICLE

BACKGROUND OF THE INVENTION

1. Field of the Invention

The present invention relates to a method of performing pretreatment for coating on a metal molded article such as an automobile body by dipping the metal molded article in a solution which is stored in a treatment bath.

2. Description of the Background Art

In general, a metal molded article such as an automobile, a household electric appliance or steel furniture is subjected to pretreatment before coating. Such pretreatment for coating includes pre-washing with hot water, degreasing, rinsing after degreasing, chemical conversion or the like. While the pretreatment is performed by a spray method or a dipping method in general, the dipping method is generally employed for an article such as an automobile body having a baggy structure part and requiring corrosion resistance after painting. In such a dipping method, the metal molded article is dipped in rinsing water or a treatment solution stored in a treatment bath, to be subjected to pretreatment for coating.

In the conventional pretreatment method for coating, however, the target to be treated cannot be homogeneously treated in an excellent state.

In case of an article such as an automobile body having a baggy structure part, for example, the rinsing water or treatment solution is so insufficiently stirred in the baggy structure part that the article cannot be homogeneously treated in an excellent state. In case of phosphating, for example, lack of hiding or yellow rusting results in a phosphate coating which is formed in the baggy structure part. Thus, it is impossible to form a phosphate coating having excellent corrosion resistance after coating.

In order to solve such a problem, Japanese Patent Publication No. 63-8820 (1988) proposes a method of providing means for upwardly spraying a treatment solution from the bottom of a boat-form treatment bath toward an article which is dipped in the treatment bath for bringing the treatment solution into contact with a concave portion on the bottom surface of the article. However, this method is effective only for an article having a constant shape, and the flowability of the treatment solution cannot be sufficiently supplied to a complicated baggy structure part of an automobile body or the like, for example.

On the other hand, Japanese Patent Laying-Open No. 2-277783 (1990) proposes a method of performing pretreatment for coating on a box-type sheet metal article by dipping the article in a treatment solution and carrying the same while providing a number of straight nozzles on both sides of the carrier path for the article for spraying the treatment solution from the straight nozzles at a flow rate of 20 to 50 l/min. under pressure of 1.0 to 10.0 kg/cm$^2$ and stirring the treatment solution in the treatment bath.

In this method, however, the treatment solution cannot be entirely homogeneously stirred but only a specific part. In order to sufficiently stir the treatment solution in the baggy structure part of the article, therefore, the positions, angles etc. for spraying the treatment solution must be adjusted. In a baggy structure part having a complicated structure, further, the stirring state in this baggy structure part cannot be improved.

The aforementioned problem of difficulty in homogenous and excellent treatment in phosphating is also important in pre-washing with hot water, degreasing, rinsing after degreasing or the like included in the pretreatment for coating.

In relation to such pretreatment for coating on a metal molded article, it is known that metal powder adhering to the metal molded article is incorporated into the treatment solution to float or suspend therein. Such metal powder may cause a problem particularly in a phosphating step. If a phosphate coating into which such metal powder is entrapped, the resulting electrodeposition coating film is disadvantageously irregularized by the metal powder and its smoothness is reduced. Such reduction of smoothness resulting from adhesion of metal powder remarkably appears on a horizontal surface of a metal molded article in particular.

SUMMARY OF THE INVENTION

An object of the present invention is to provide a pretreatment method for coating, which can more homogeneously and excellently treat a metal molded article by dipping the same in a solution stored in a treatment bath while more effectively preventing the metal molded article from adhesion of metal powder.

A pretreatment method for coating according to a first aspect of the present invention is adapted to dip a metal molded article in a solution which is stored in a treatment bath, and characterized in that the solution stored in the treatment bath is stirred by vibration stirring means which is provided in the treatment bath for stirring the solution in the range receiving the dipped metal molded article so that the mean acceleration a expressed in the following equation is at least 8 cm/sec$^2$:

$$a = \sqrt{X^2 + Y^2 + Z^2}$$

where X, Y and Z, which are in units of cm/sec$^2$, represent average acceleration values of flow rate changes within 60 seconds, measured simultaneously in three axial directions of X, Y and Z which are perpendicular to each other at a measuring position.

A pretreatment method for coating according to a second aspect of the present invention is adapted to dip a metal molded article in a solution which is stored in a treatment bath while carrying the same, and characterized in that vibration stirring means is provided on an inlet part for introducing the metal molded article into the treatment bath for stirring the solution in the inlet part by the vibration stirring means so that the mean acceleration a expressed in the above equation is at least 8 cm/sec$^2$.

A pretreatment method for coating according to a third aspect of the present invention is adapted to dip a metal molded article having a substantially horizontal surface in a solution which is stored in a treatment bath, and characterized in that the solution around the horizontal surface of the metal molded article dipped in the solution is stirred by vibration stirring means provided in the treatment bath so that the mean acceleration a expressed in the above equation is at least 8 cm/sec$^2$.

A pretreatment method for coating according to a fourth aspect of the present invention is adapted to dip a metal molded article having a substantially horizontal surface in a solution which is stored in a treatment bath while carrying the same, and characterized in that vibration stirring means is provided on an inlet part for introducing the metal molded article into the treatment bath for stirring the solution in the inlet part by the vibration stirring means so that the mean acceleration a expressed in the above equation is at least 8 cm/sec$^2$.

In each of the third and fourth aspects of the present invention, the wording "substantially horizontal surface of the metal molded article" indicates a surface to which metal powder easily adheres in the pretreatment for coating, and includes a surface which is inclined in the range of ±45° with respect to the horizontal direction, in specifically.

The items which are common to the first, second, third and fourth aspects of the present invention are described hereafter simply referred to as "the present invention".

The pretreatment for coating according to the present invention is directed to treatment such as pre-washing with hot water, degreasing, rinsing after degreasing, chemical conversion coating or the like. The dipping time in the treatment bath, which is properly selected in response to the type of the treatment, is at least 10 seconds in general. When phosphating is performed as the pretreatment for coating, the solution is preferably stirred at the aforementioned mean acceleration for at least 30 seconds. According to each of the second and fourth aspects of the present invention, the solution is preferably stirred in the inlet part at the aforementioned mean acceleration for at least 30 seconds. According to the third aspect of the present invention, on the other hand, the solution is preferably stirred at the aforementioned mean acceleration for at least 30 seconds after starting of the treatment.

In the pretreatment for coating according to the present invention, the solution is stirred by the vibration stirring means provided in the treatment bath. According to each of the second and fourth aspects of the present invention, the vibration stirring means is provided on the inlet part of the treatment bath. An example of such vibration stirring means is an apparatus having a diaphragm in the solution stored in the treatment bath for stirring the solution by vibrating the diaphragm. Preferably, a plurality of such diaphragms are arranged in the vertical direction in response to the size of the treatment bath. The shape of each diaphragm can be set in response to the size of the treatment bath, the method of dipping the article and the like. Vibration of the diaphragm (s) is generally made by transmitting vibration of a vibrating motor.

In the pretreatment method for coating according to the present invention, the solution is so stirred that the mean acceleration a is at least 8 cm/sec$^2$ for treating the article. Preferably, the solution is so stirred that the mean acceleration a is at least 10 cm/sec$^2$, more preferably, 10 to 50 cm/sec$^2$, more preferably, 10 to 30 cm/sec$^2$.

According to the first aspect of the present invention, the solution in the range of receiving the metal molded article is stirred at the aforementioned mean acceleration. The aforementioned mean acceleration may be attained as a mean value in the region of receiving the metal molded article. In relation to the mean acceleration, it is preferable to measure the value in the vicinity of the treated surface of the metal molded article which is dipped in the solution. If an influence exerted on the mean acceleration by dipping of the metal molded article is small or measurement in the dipped state is difficult, however, the mean acceleration may alternatively be measured before dipping of the metal molded article in a position for receiving the same.

According to the second aspect of the present invention, the aforementioned mean acceleration may be attained in the inlet part for introducing the metal molded article into the treatment bath. The mean acceleration may be attained as the mean value in the inlet part. In relation to the mean acceleration, it is preferable to measure the value in the vicinity of the treated surface of the metal molded article which is dipped in the solution. If an influence exerted on the mean acceleration by dipping of the metal molded article is small or measurement in the dipped state is difficult, however, the mean acceleration may alternatively be measured before dipping of the metal molded article in a position for receiving the same.

According to each of the third and fourth aspects of the present invention, pretreatment is performed while stirring the solution around the substantially horizontal surface of the metal article at the aforementioned mean acceleration. The aforementioned mean acceleration may be attained as a mean value around the substantially horizontal surface. If an influence exerted on the mean acceleration by dipping of the metal molded article is small or measurement in the dipped state is difficult, however, the mean acceleration may alternatively be measured before dipping of the metal molded article in a position for receiving the same.

If the mean acceleration a is smaller than the aforementioned value in each of the first and second aspects of the present invention, it is difficult to make homogeneous and excellent pretreatment. If the mean acceleration a is too large, on the other hand, no further excellent treatment effect can be attained while the treatment solution may splash from or overflow the treatment bath, to result in irregular treatment.

If the mean acceleration a is smaller than the aforementioned value in each of the third and fourth aspects of the present invention, metal powder easily adheres to the article. If the article is subjected to electrodeposition coating, therefore, no smoothness can be attained on the obtained film. If the mean acceleration a is too large, on the other hand, no further excellent treatment effect can be attained while the treatment solution may splash from or overflow the treatment bath, to result in irregular treatment.

As hereinabove described, the mean acceleration a can be calculated by measuring the change of the flow rate of the solution with time. This flow rate of the solution can be measured by a three-dimensional electromagnetic current meter having a measurement principle based on the Faraday's law of electromagnetic induction. When such a current meter is employed, mean acceleration values in the directions of X, Y and Z can be obtained to calculate the three-dimensional mean acceleration a.

In case of measuring the mean acceleration a around the treated surface of the metal molded article, the mean acceleration a is preferably measured in the range up to a position separated from the surface by 20 cm. More preferably, the mean acceleration a is measured at a position separated from the surface by about 10 cm. If the metal molded article is moved in the pretreatment for coating, a measuring apparatus may be held by means for carrying the metal molded article, for example, so that the measuring apparatus is moved along with the metal molded article. Alternatively, measuring apparatuses may be set along the route for moving the metal molded article at prescribed intervals, for measuring the mean acceleration a at a predetermined position.

In case of measuring the mean acceleration a without dipping the metal molded article in the treatment bath, it is preferable to measure the mean acceleration a in a position where the treated surface is located when the metal molded article is dipped in the treatment bath. If the measurement is made in the range of 20 cm from the position of the treated surface located when the metal molded article is dipped, the measurement can be regarded as substantially equal to that perfomed at the position of the treated surface.

According to the pretreatment method for coating in each of the first and second aspects of the present invention, a sufficient effect can be attained in treatment on the interior of a baggy structure part of a metal molded article, for which no sufficient effect can be attained in the prior art.

According to the pretreatment method for coating in each of the third and fourth aspects of the present invention, it is possible to prevent adhesion of metal powder to the substantially horizontal surface of the metal molded article. When chemical conversion is performed as the pretreatment for coating, therefore, it is possible to prevent the metal powder from being entrapped in the chemical conversion coating, thereby improving smoothness of a film formed thereon.

When phosphating is performed as the pretreatment for coating according to the present invention, the composition of the treatment bath is not particularly restricted but the treatment bath is prepared from 0.5 to 2.5 g/l of zinc ion, 0.1 to 3 g/l of manganese ion, 5 to 40 g/l of phosphate ion, 0.05 to 3 g/l of a fluorine compound as HF, and at least one chemical conversion accelerator selected from 0.01 to 0.5 g/l of nitrite ion, 0.5 to 10 g/l of hydrogen peroxide, and 0.05 to 5 g/l of nitrobenzenesulfonate ion, for example.

If the content of zinc ion is less than 0.5 g/l, lack of hiding or yellow rusting may result in the phosphate coating to reduce corrosion resistance after coating. If the content exceeds 2.5 g/l, on the other hand, coating adhesion may disadvantageously be reduced with respect to a metal molded article having a zinc metal surface. The content of zinc ion is more preferably 0.8 to 1.5 g/l.

If the content of manganese ion is less than 0.1 g/l, coating adhesion and corrosion resistance after coating may be reduced when the metal molded article has a zinc metal surface. If the content exceeds 3 g/l, on the other hand, no further particular effect is attained but the method is economically disadvantageous. The content of manganese ion is more preferably 0.8 to 2.0 g/l.

If the content of phosphate ion is less than 5 g/l, the bath composition may so remarkably fluctuate that no excellent coating can be stably formed. If the content exceeds 40 g/l, on the other hand, no further particular improvement of the effect is attained but the method is economically disadvantageous. The content of phosphate ion is more preferably 10 to 20 g/l.

If the content of the fluorine compound is less than 0.05/l as HF, the bath composition may so remarkably fluctuate that no excellent coating can be stably formed. If the content exceeds 3 g/l, on the other hand, no further particular improvement of the effect is attained but the method is economically disadvantageous. The fluorine compound may be prepared from hydrofluoric acid, silicofluoric acid, fluoroboric acid, zirconium hydrofluoric acid, titanium hydrofluoric acid, or alkaline or ammonium salt thereof. The content of the fluorine compound is more preferably 0.3 to 1.5 g/l as HF. The chemical conversion accelerator contained in the treatment solution can be prepared from at least one selected from nitrite, hydrogen peroxide and m-nitrobenzenesulfonate, as described above. The content of independently employed nitrite is preferably 0.01 to 0.5 g/l. The content of independently employed hydrogen peroxide is preferably 0.5 to 10 g/l. The content of independently employed m-nitrobenzenesulfonate is preferably 0.05 to 5 g/l. If the content of the chemical conversion accelerator is less than the aforementioned range, corrosion resistance may be reduced in a salt spray test (SST: JIS-Z-2371). If the content exceeds the aforementioned range, on the other hand, no further particular effect is attained but the method is economically disadvantageous.

The treatment solution may further contain 2 to 20 g/l of nitrate ion. Alternatively, the treatment solution may further contain 0.05 to 2 g/l of chlorate ion.

The free acidity of the treatment solution is preferably 0.5 to 2.0 points. This free acidity of the treatment solution can be obtained by collecting 10 ml of the treatment solution and titrating the sample with 0.1N caustic soda, with an indicator of Bromophenol Blue. If the free acidity is less than 0.5 points, stability of the treatment solution may be reduced to result in formation of sludge. If the free acidity exceeds 2.0 points, on the other hand, corrosion resistance may be reduced in the SST.

The treatment solution may further contain nickel ion, preferably in the range of 0.1 to 6.0 g/l, and more preferably in the range of 0.1 to 2.0 g/l.

The treatment temperature for phosphating can be properly selected in the range of the room temperature (20° C.) to 70° C., and the treatment time is preferably at least 30 seconds, and more preferably 1 to 2 minutes.

According to each of the first and second aspects of the present invention, the solution in the range of receiving the dipped metal molded article is so stirred that the mean acceleration a is at least 8 cm/sec$^2$, whereby pretreatment for coating can be more homogeneously performed in an excellent state.

According to each of the third and fourth aspects of the present invention, the solution around the substantially horizontal surface of the metal molded article is so stirred that the mean acceleration a is at least 8 cm/sec$^2$, whereby adhesion of metal powder can be prevented and a film having excellent smoothness can be formed in coating after the pretreatment.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 3 is a perspective view showing portion for dipping test pieces in an article dipping range and points for measuring mean acceleration values a.

DESCRIPTION OF THE PREFERRED EMBODIMENTS

Figure 1:
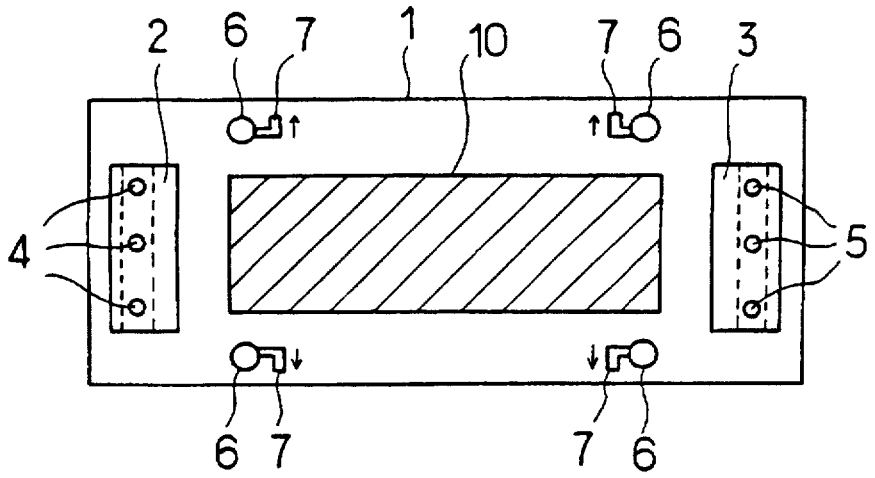
FIG. 1 is a plan view showing a treatment bath employed in an embodiment of the present invention.
Figure 2:
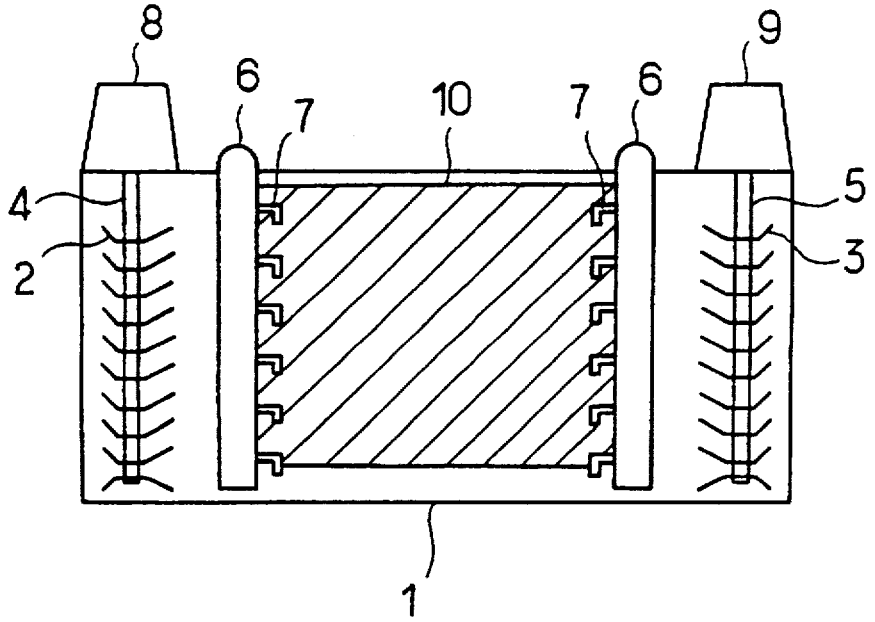
FIG. 2 is a side sectional view of the treatment bath employed in the embodiment of the present invention.

FIGS. 1 and 2 illustrate a treatment bath for phosphating, which is employed in an embodiment of a pretreatment method for coating according to the present invention. FIG. 1 is a plan view, and FIG. 2 is a side sectional view. The treatment bath 1 is 1000 mm in width, 1650 mm in height, and 2300 mm in length.

Referring to FIGS. 1 and 2, the treatment bath 1 in this embodiment is provided on both longitudinal ends with vibration stirrers 8 and 9 serving as vibration stirring means. The vibration stirrers 8 and 9 are adapted to stir a treatment solution stored in the treatment bath 1 by vibrating diaphragms 2 and 3 mounted on vibrating rods 4 and 5 in the treatment bath 1. According to this embodiment, 23 pieces of diaphragms 2 and 23 pieces of diaphragms 3 are mounted at intervals of about 50 mm.

Further, the treatment bath 1 is provided with pump stirring risers 6 for stirring the treatment solution by pump stirring. The pump stirring risers 6 are provided on four portions in the treatment bath 1, for enclosing a range 10 for receiving an article which is dipped in the treatment bath 1. As shown in FIGS. 1 and 2, each of the pump stirring risers 6 is provided with a plurality of discharge pipes 7, which are adapted to discharge the treatment solution supplied from the corresponding pump stirring riser 6 toward a wall surface of the treatment bath 1. These pump stirring risers 6 are stirrers for comparative pump stirring.

EXAMPLES 1 AND 2

Figure 3:
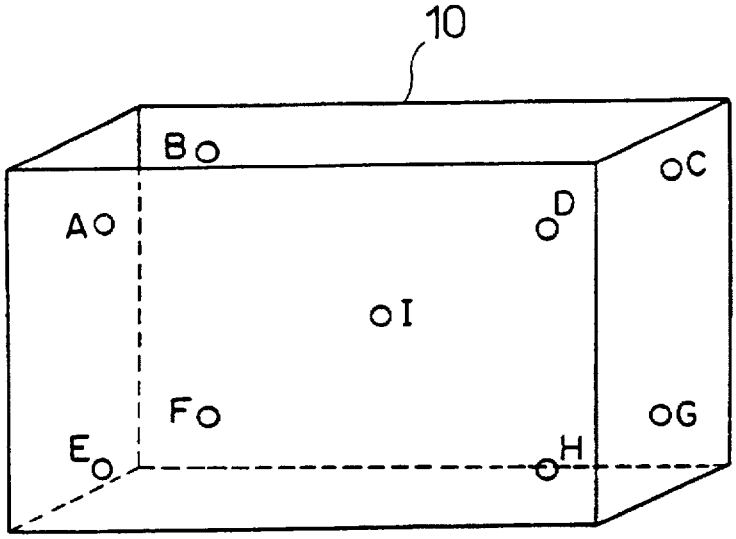
Figure 10:
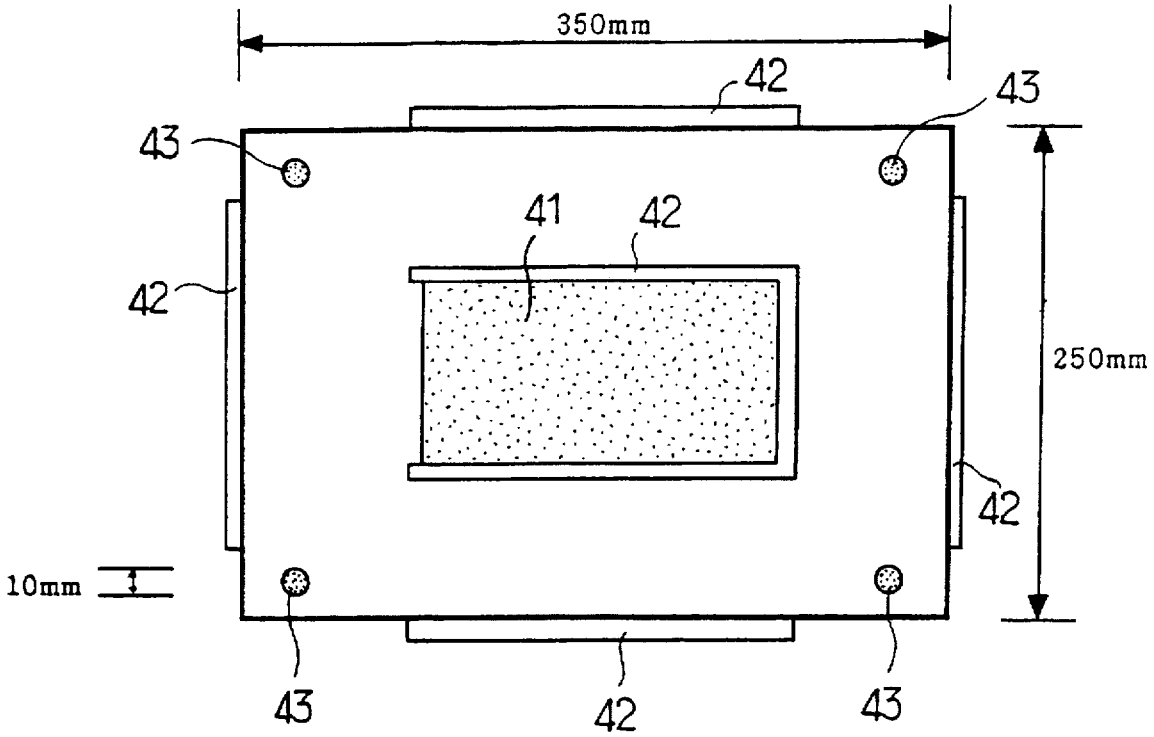
FIG. 10 is a plan view showing a holder for holding test pieces employed in Example of the present invention.
Figure 11:
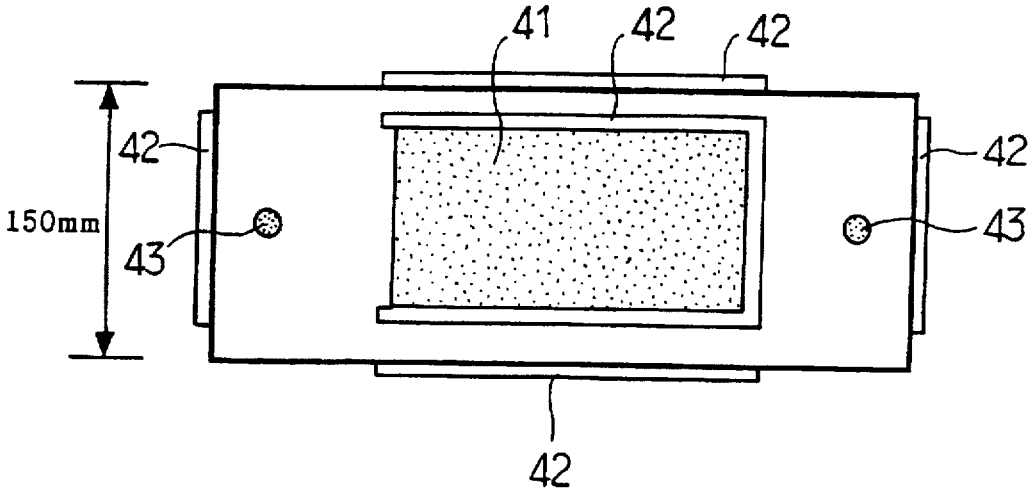
FIG. 11 is a front elevational view showing the holder for holding the test pieces employed in Example of the present invention.
Figure 12:
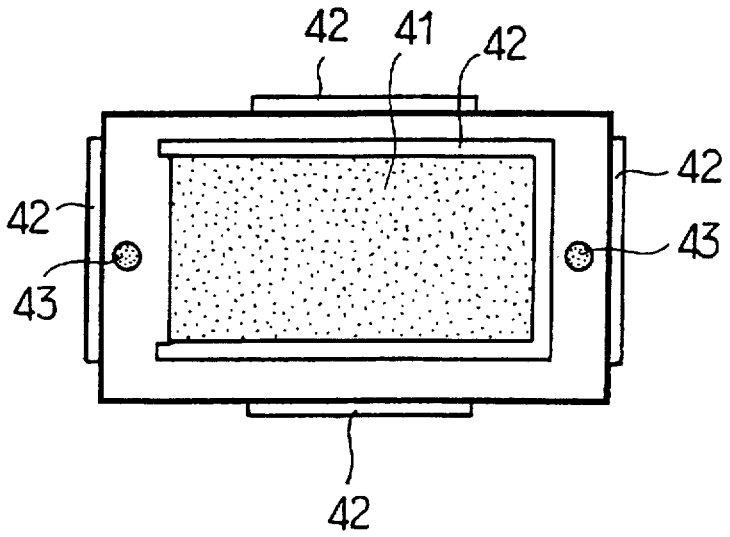
FIG. 12 is a side elevational view showing the holder for holding the test pieces employed in Example of the present invention.

The treatment bath shown in FIGS. 1 and 2 was employed for performing zinc phosphate chemical conversion according to the first aspect of the present invention. Test pieces were prepared by previously cleaning cold-drawn steel plates (SPC) of 70×150×0.8 mm with alkali for surface adjustment. These test pieces were set on respective surfaces of a regular-hexahedral holder shown in FIGS. 10 to 12, and such holders were dipped in nine portions A to I in the article receiving range 10, as shown in FIG. 3. In other words, six test pieces were dipped in each of the portions A to I. FIGS. 10, 11 and 12 are a plan view, a front elevational view and a side elevational view of the holder respectively. As shown in FIGS. 10 to 12, openings 41 are formed in the central portion of the respective surfaces of the holder, and frames 42 are provided around the openings 41. The test pieces are held by the frames 42. As shown in FIGS. 10 to 12, further, circular openings 43 of 10 mm in diameter are formed in peripheral portion of the respective surfaces. The treatment solution flows into the holder through such openings 43, to be capable of coming into contact with inner side surfaces of the test pieces, for treating the inner side surfaces too.

Table 1 shows the composition of the treatment solution employed for the zinc phosphate chemical conversion.

TABLE 1

| Composition of Treatment Solution | |
|---|---|
| Zn (g/l) | 1.0 |
| Ni (g/l) | 1.0 |
| Mn (g/l) | 0.7 |
| $PO_4$ (g/l) | 15.0 |
| $NO_3$ (g/l) | 6.0 |
| $SiF_6$ (g/l) (as HF) | 1.0 |
| $NO_2$ (g/l) | 0.06 |
| Free Acidity (point) | 0.6 |
| Temperature (° C.) | 40 |

Figure 4:
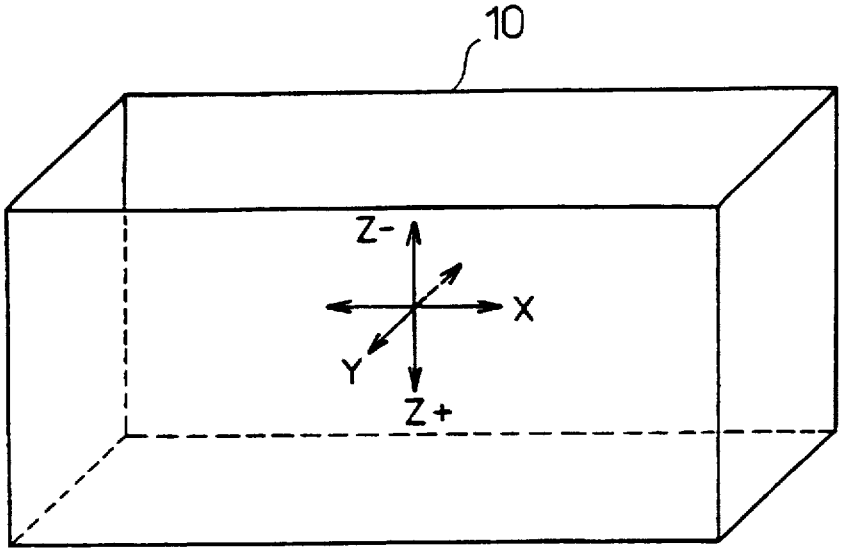
FIG. 4 is a perspective view showing direction X, Y and Z for measuring flow rates in the article dipping range.

Before dipping the test pieces, the treatment solution was brought into a stirred state similar to that in treatment, so that flow rates and flow rate changes were measured at the respective portion A to I shown in FIG. 3. A three-dimensional electromagnetic current meter ("ACM300-A" by Alec Electronics Co., Ltd.) was employed to measure the flow rates and the flow rate changes in the directions of X, Y and Z for measurement as shown in FIG. 4. Namely, the direction X, Y and Z were along the length, the width and the height of the treatment bath respectively. As to the direction Z, the direction toward the bottom of the treatment bath was referred to as direction $Z^+$ and the direction toward the solution surface was referred to as direction $Z^-$.

Figure 5:
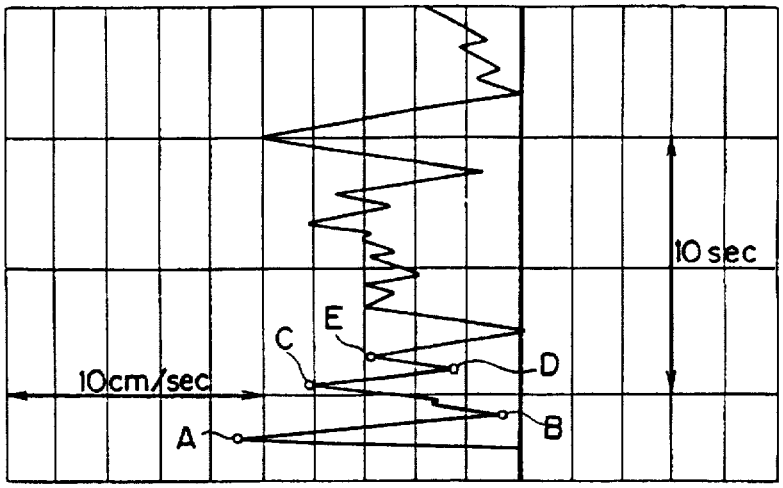
FIG. 5 illustrates a flow rate measurement chart.

At the respective measuring points, the flow rates in the direction of X, Y and Z were measured every 0.5 seconds, and the acceleration values were measured from a recording chart thereof. FIG. 5 illustrates an exemplary flow rate recording chart. In such a recording chart, changes of the flow rates between peak points and next peak points and times therebetween were measured, and the flow rate changes were divided by the times to obtain the acceleration values. Referring to FIG. 5, the changes of the flow rates and the times were measured between the peaks A and B, B and C, C and D, and D and E respectively, for calculating mean acceleration values in 60 seconds.

The mean acceleration values in the directions of X, Y and Z calculated in the aforementioned manner were converted to three-dimensional mean acceleration values a by the following equation:

$$a = \sqrt{X^2 + Y^2 + Z^2}$$

Tables 2 and 3 show the mean acceleration values at the respective measuring points A to I.

As to the test pieces subjected to zinc phosphate chemical conversion at the respective measuring points A to I, the chemical conversion coatings were observed with the naked eye and an optical microscope respectively, for evaluating chemical conversion properties with ⊙ on each portion presenting homogeneous and dense chemical conversion coatings on all of the six test pieces, ○ on each portion forming chemical conversion coatings on all of the six test pieces with no defectives such as lack of hiding or yellow rusting, and X on each portion causing lack of hiding or yellow rusting on at least one of the six test pieces. Tables 2 and 3 also show the chemical conversion properties at the respective measuring points A to I.

In Examples 1 and 2 according to the first aspect of the present invention, the test pieces were treated in such a stirring state that the mean acceleration a in the flowing state of the solution in the range receiving the dipped test pieces was within the inventive range. Table 2 shows the results.

COMPARATIVE EXAMPLES 1 AND 2

For the purpose of comparison, a vibration stirrer was employed for stirring a solution in a flowing state in a range for receiving dipped test pieces at mean acceleration a which was downward beyond the inventive range, as comparative example 1. On the other hand, a solution for receiving dipped test pieces was stirred by pump stirring with no vibration stirrer, as comparative example 2. Table 3 shows results of measurement on these comparative examples 1 and 2.

Comparing Tables 2 and 3 with each other, it is clearly understood that an excellent chemical conversion coating can be formed by stirring a solution in the range of receiving an article at mean acceleration a of at least 8 cm/sec$^2$ according to the first aspect of the present invention.

EXAMPLE 3

The treatment bath shown in FIGS. 1 and 2 was employed for performing zinc phosphate chemical conversion according to the third aspect of the present invention. A test piece was prepared from a cold-drawn steel plate (SPC) of 100×300×0.8 mm which was previously cleaned with alkali and subjected to surface adjustment. In the alkali cleaning, the test piece was dipped in a 2% aqueous solution of "Surf Cleaner SD250" (trade name) by Nippon Paint Co., Ltd., serving as an alkaline degreasing agent, at 40° C. for 2 minutes. In the surface adjustment, the test piece was dipped in a 0.1% aqueous solution of "Surf Fine 5N-5" (trade name) by Nippon Paint Co., Ltd., serving as a surface adjuster, at 40° C. for 20 seconds.

The aforementioned test piece was suspended to be horizontally located on a position of 300 mm under the central solution level of the treatment bath shown in FIGS. 1 and 2, and subjected to zinc phosphate chemical conversion. The treatment solution for the zinc phosphate chemical conversion was prepared from that of the composition shown in Table 1 employed in Examples 1 and 2, with dispersion of 5 ppm of iron powder having a mean particle size of 20 μm. The treatment solution was stirred by a vibration stirrer, so that the mean acceleration a was within the range of the present invention. The mean acceleration a was measured by a current meter which was similar to those employed in Examples 1 and 2. A measuring point was set on a position of 100 mm above the test piece. Direction X, Y and Z were set to be similar to those in Examples 1 and 2. Mean acceleration values in 60 seconds were measured. Table 4 shows the mean acceleration values in the direction of X, Y and Z and the mean acceleration a.

The test piece chemically converted in the aforementioned manner was washed with tap water, then washed with ion exchanged water, and thereafter subjected to electrodeposition coating with a cation electrodeposition paint ("Power Top U-1000" (trade name) by Nippon Paint Co., Ltd.) so that the dry thickness was 30 μm. Smoothness of the film obtained after the coating was observed with the naked eye, and evaluated on the following basis:

○: no irregularity was observed on the film surface

Δ: irregularity was observed on the film surface

X: irregularity was remarkably observed on the film surface

Table 4 also shows smoothness of the film.

COMPARATIVE EXAMPLES 3 AND 4

A test piece was chemically converted and subjected to electrodeposition coating similarly to Example 3 except that a treatment solution was stirred so that the mean acceleration a was downward beyond the inventive range, and smoothness of the obtained film was evaluated (comparative example 3). Table 4 shows the mean acceleration of the treatment solution in the chemical conversion and the smoothness of the film. On the other hand, another test piece was chemically converted similarly to Example 3 and subjected to electrodeposition coating similarly to Example 3 except that a treatment solution was stirred by pump stirring with no vibration stirrer, and smoothness of the obtained film was evaluated (comparative example 4). Table 4 shows the mean acceleration of the treatment solution in the conversion and the smoothness of the film.

It is clearly understood from Table 4 that a zinc phosphate coating can be prevented from entrapping of metal powder by stirring a treatment solution around a treated surface at mean acceleration a of at least 8 cm/sec$^2$ in chemical conversion, thereby attaining excellent smoothness of the film.

EXAMPLE 4

A test piece was chemically converted similarly to Example 3 except that a treatment solution was stirred by vibration stirring for 30 seconds after starting of the treatment, then stirred by pump stirring for 90 seconds and subjected to electrodeposition coating, so that smoothness of the obtained film was evaluated. Table 5 shows mean acceleration values in the first stage of 30 seconds (vibration stirring) and in the second stage of 90 seconds (pump stirring), and smoothness of the film. The mean acceleration in the first stage of 30 seconds was measured by stirring the treatment solution for 60 seconds, while the test piece was treated for 30 seconds under the same vibration stirring condition.

It is clearly understood from Table 5 that adhesion of metal powder can be effectively prevented by stirring the treatment solution at the mean acceleration a defined in the present invention in the initial stage of 30 seconds in the chemical conversion, thereby obtaining excellent smoothness of the film.

Figure 6:
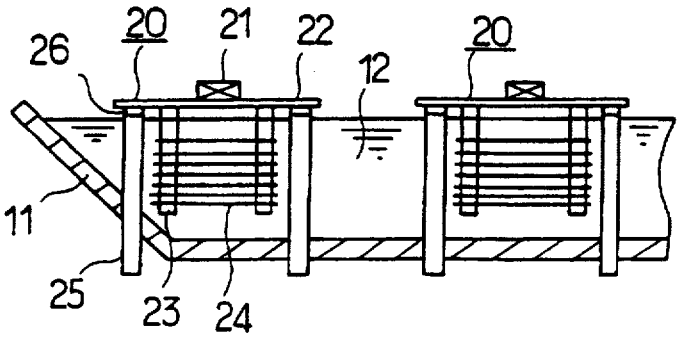
FIG. 6 is a side elevational view showing a treatment bath employed in another embodiment of the present invention.
Figure 7:
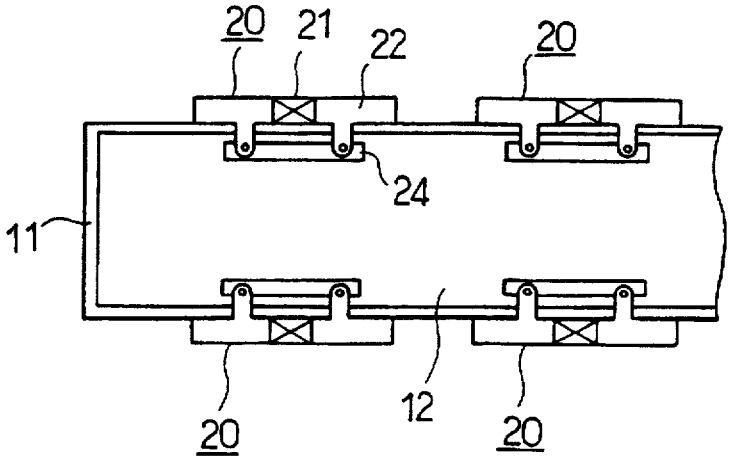
FIG. 7 is a plan view of the treatment bath shown in FIG. 6.

FIGS. 6 and 7 are a side elevational view and a plan view showing an inlet part of a treatment bath for performing zinc phosphate chemical conversion of a metal molded article such as an automobile body in accordance with the present invention. As shown in FIGS. 6 and 7, the inlet part of a boat-form treatment bath 11 is provided on both sides with pairs of vibration stirrers 20 in two stages. In other words, four vibration stirrers 20 are provided in total. Each vibration stirrer 20 has a plurality of diaphragms 24 which are dipped in a treatment solution 12 stored in the treatment bath 11. These diaphragms 24 are supported by vibrating bars 23 in the vicinity of both ends respectively. Upper portion of the vibrating bars 23 are mounted on vibrating frames 22. The vibrating frames 22 outwardly extend from both side portion of the treatment bath 11, so that both end portion thereof are placed on a table 25 through springs 26. Vibrating motors 21 are provided on central portion of the vibrating frames 22 outward beyond the treatment bath 11.

Vibration generated from the vibrating motors 21 is transmitted to the vibrating frames 22, to vibrate the diaphragms 24 through the vibrating bars 23. Due to the vibration of the diaphragms 24, the zinc phosphate treatment solution 12 stored in the treatment bath 11 is stirred.

Figure 8:
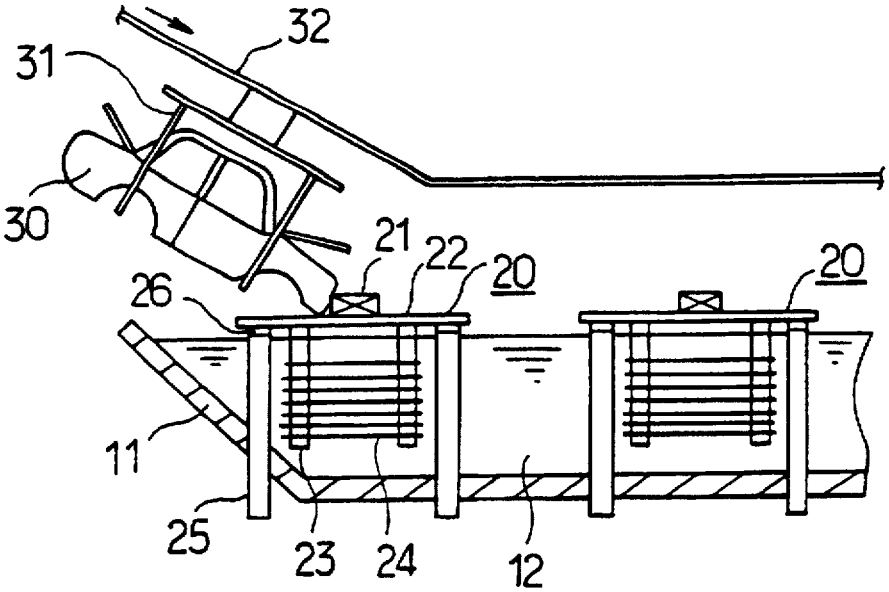
FIG. 8 is a side elevational view showing an automobile body which is dipped in the treatment bath as an article.
Figure 9:
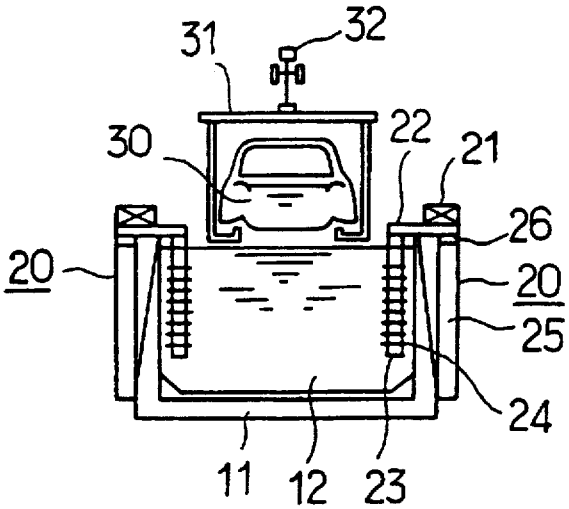
FIG. 9 is a front elevational view showing the automobile body which is dipped in the treatment bath as an article.

FIGS. 8 and 9 are a side elevational view and a front elevational view showing an automobile body 30, which is an article to be treated, which is carried and dipped in the zinc phosphate treatment solution 12 stored in the treatment bath 11.

As shown in FIGS. 8 and 9, the automobile body 30 is suspended by a hanger 31, and carried by a conveyor 32 which is carrier means, to be dipped in the zinc phosphate treatment solution 12 in the treatment bath 11.

The pretreatment method for coating according to each of the first and second aspects of the present invention is adapted to stir the zinc phosphate treatment solution 12 in the treatment bath 11 by the vibration stirrers 20 provided in the treatment bath 11 as shown in FIGS. 8 and 9, so that the mean acceleration a of the treatment solution 12 in the range of receiving the automobile body 30 is at least 8 cm/sec$^2$. The automobile body 30 is treated in the inlet part of the zinc phosphate treatment solution 12 for at least 30 seconds in general.

In the pretreatment method for coating according to each of the third and fourth aspects of the present invention, the zinc phosphate treatment solution 12 in the treatment bath 11 is stirred by the vibration stirrers 20 provided in the treatment bath 11 so that the mean acceleration a of the treatment solution 12 around a substantially horizontal surface such as a surface of the roof or the hood of the automobile body 30 is at least 8 cm/sec$^2$. The automobile body 30 is preferably treated in the zinc phosphate treatment solution 12 in the inlet part for at least 30 seconds, in general. When the treatment in such a vibration-stirring state is performed for at least 30 seconds after starting of the chemical conversion, the substantially horizontal surface such as the surface of the roof or the hood of the automobile body 30 can be effectively prevented from adhesion of metal powder, whereby smoothness of the film formed thereon can be improved.

According to the present invention, the vibration number, the vibration width etc. as well as the shape, the size etc. of the diaphragms are so adjusted and set that the mean acceleration a of the zinc phosphate treatment solution 12 is at least 8 cm/sec$^2$, as hereinabove described.

While the above description has been made with reference to zinc phosphate chemical conversion as the pretreatment for coating, the inventive pretreatment for coating is not restricted to this but the present invention is also applicable to other pretreatment for coating such as chromating, prewashing, degreasing, rinsing after degreasing or the like.

Although the present invention has been described and illustrated in detail, it is clearly understood that the same is by way of illustration and example only and is not to be taken by way of limitation, the spirit and scope of the present invention being limited only by the terms of the appended claims.

TABLE 2

| Measuring Point in Treatment Bath | Example 1 Mean Acceleration (cm/sec$^2$) X | Y | Z | a | Example 1 Chemical Conversion Property (Outer Surface/Inner Surface) | Example 2 Mean Acceleration (cm/sec$^2$) X | Y | Z | a | Example 2 Chemical Conversion Property (Outer Surface/Inner Surface) |
|---|---|---|---|---|---|---|---|---|---|---|
| A | 8.7 | 7.8 | 7.6 | 14.0 | ◎/◎ | 7.4 | 3.2 | 3.3 | 8.7 | ◎/○ |
| B | 8.6 | 7.7 | 7.6 | 14.4 | ◎/◎ | 7.2 | 3.3 | 3.3 | 8.6 | ◎/○ |
| C | 8.6 | 7.7 | 7.5 | 13.8 | ◎/◎ | 7.2 | 3.2 | 3.2 | 8.5 | ◎/○ |
| D | 8.8 | 7.7 | 7.7 | 14.0 | ◎/◎ | 7.3 | 3.3 | 3.3 | 8.7 | ◎/○ |
| E | 8.8 | 7.7 | 7.5 | 13.9 | ◎/◎ | 7.3 | 4.6 | 5.4 | 10.2 | ◎/◎ |
| F | 8.8 | 7.7 | 7.8 | 14.1 | ◎/◎ | 7.3 | 4.7 | 5.4 | 10.2 | ◎/◎ |
| G | 8.9 | 7.8 | 7.7 | 14.1 | ◎/◎ | 7.3 | 4.8 | 5.2 | 10.2 | ◎/◎ |
| H | 8.8 | 7.8 | 7.8 | 14.1 | ◎/◎ | 7.0 | 4.9 | 5.4 | 10.1 | ◎/◎ |
| I | 8.9 | 7.9 | 8.2 | 14.5 | ◎/◎ | 7.1 | 7.2 | 8.7 | 13.3 | ◎/◎ |

TABLE 3

| Measuring Point in Treatment Bath | Comparative Example 1 Mean Acceleration (cm/sec$^2$) X | Y | Z | a | Comparative Example 1 Chemical Conversion Property (Outer Surface/Inner Surface) | Comparative Example 2 Mean Acceleration (cm/sec$^2$) X | Y | Z | a | Comparative Example 2 Chemical Conversion Property (Outer Surface/Inner Surface) |
|---|---|---|---|---|---|---|---|---|---|---|
| A | 3.9 | 3.1 | 2.1 | 5.4 | ○/X | 2.9 | 3.1 | 1.5 | 4.5 | X/X |
| B | 4.0 | 3.1 | 2.3 | 5.6 | ○/X | 3.1 | 3.0 | 1.4 | 4.5 | X/X |
| C | 4.1 | 2.9 | 2.1 | 5.4 | ○/X | 3.1 | 3.0 | 1.5 | 4.6 | X/X |
| D | 4.0 | 3.0 | 2.3 | 5.5 | ○/X | 3.0 | 2.9 | 1.5 | 4.4 | X/X |
| E | 4.9 | 3.0 | 4.1 | 7.1 | ○/X | 2.8 | 3.1 | 3.0 | 5.1 | ○/X |
| F | 4.8 | 3.2 | 3.9 | 7.0 | ○/X | 2.8 | 3.1 | 3.2 | 5.3 | ○/X |
| G | 5.0 | 2.9 | 4.2 | 7.1 | ○/X | 2.8 | 3.2 | 3.4 | 5.4 | ○/X |
| H | 4.9 | 2.9 | 4.0 | 7.0 | ○/X | 2.9 | 3.0 | 3.4 | 5.4 | ○/X |
| I | 2.3 | 2.1 | 2.2 | 3.8 | X/X | 2.9 | 3.2 | 3.0 | 5.3 | ○/X |

TABLE 4

| | Stirring | Mean Acceleration (cm/sec²) X | Y | Z | a | Smoothness |
|---|---|---|---|---|---|---|
| Example 3 | Vibration Stirring | 8.9 | 7.5 | 5.2 | 12.7 | ○ |
| Comparative Example 3 | Vibration Stirring | 4.9 | 2.8 | 3.1 | 6.4 | Δ |
| Comparative Example 4 | Pump Stirring | 3.1 | 3.0 | 1.2 | 4.5 | X |

TABLE 5

| | First Stage of 30 Sec. | | | | | Second Stage of 90 Sec. | | | | | |
|---|---|---|---|---|---|---|---|---|---|---|---|
| | | Mean Acceleration (cm/sec²) | | | | | Mean Acceleration (cm/sec²) | | | | |
| | Stirring | X | Y | Z | a | Stirring | X | Y | Z | a | Smoothness |
| Example 4 | Vibration Stirring | 8.8 | 7.8 | 5.3 | 12.9 | Pump Stirring | 3.1 | 3.0 | 1.3 | 4.5 | ○ |

What is claimed is:

1. A pretreatment method for coating on a molded metal article having a substantially horizontal surface comprising the steps of:

carrying and dipping said molded metal article in a solution stored in a treatment bath; and agitating said solution around said horizontal surface of said molded metal article in an inlet part of said treatment bath for introducing said molded metal article into said treatment bath, by vibration of a plurality of vibrating plates of vibration agitation means provided in said inlet part, so that mean acceleration a expressed in the following equation is at least 8 cm/sec²:

$$\alpha = \sqrt{X^2 + Y^2 + Z^2}$$

where X, Y and Z, which are in units of cm/sec², represent average acceleration values of flow rate changes within 60 seconds, measured simultaneously in three axial directions of X, Y and Z which are perpendicular to each other at a measuring position.

2. The pretreatment method for coating on a metal molded article in accordance with claim 1, wherein the treatment time in said inlet part is at least 30 seconds.

3. The pretreatment method for coating on a metal molded article in accordance with claim 1, wherein said treatment is performed by agitating said solution so that said mean acceleration a is 10 to 50 cm/sec².

4. The pretreatment method for coating on a metal molded article in accordance with claim 1, wherein said treatment is performed by agitating said solution so that said mean acceleration a is 10 to 30 cm/sec².

5. The pretreatment method for coating on a metal molded article in accordance with claim 1, wherein said pretreatment for coating is phosphating.

6. The pretreatment method for coating on a metal molded article in accordance with claim 1, wherein said pretreatment for coating is phosphating, and the composition of said treatment solution stored in said treatment bath is prepared from 0.5 to 2.5 g/l of zinc ion, 0.1 to 3 g/l of manganese ion, 5 to 40 g/l of phosphate ion, 0.05 to 3 g/l of a fluorine compound as HF, and at least one chemical conversion accelerator selected from 0.01 to 0.5 g/l of nitrite ion, 0.5 to 10 g/l of hydrogen peroxide, and 0.05 to 5 g/l of nitrobenzenesulfonate ion.

7. A pretreatment method for coating on a molded metal article comprising the steps of:

carrying and dipping said molded metal article in a solution in a treatment bath; and agitating said solution in an inlet part of said treatment bath for introducing said molded metal article into said treatment bath, by vibration of a plurality of vibrating plates of vibration agitation means provided in said inlet part, so that mean acceleration a expressed in the following equation is at least 8 cm/sec²:

$$a = \sqrt{X^2 + Y^2 + Z^2}$$

where X, Y and Z, which are in units of cm/sec², represent average acceleration values of flow rate changes within 60 seconds, measured simultaneously in three axial directions of X, Y and Z which are perpendicular to each other at a measuring position.

8. The pretreatment method for coating on a metal molded article in accordance with claim 7, wherein the treatment time in said inlet part is at least 30 seconds.

9. The pretreatment method for coating on a metal molded article in accordance with claim 7, wherein said treatment is performed by agitating said solution so that said mean acceleration a is 10 to 50 cm/sec².

10. The pretreatment method for coating on a metal molded article in accordance with claim 7, wherein said treatment is performed by agitating said solution so that said mean acceleration a is 10 to 30 cm/sec².

11. The pretreatment method for coating on a metal molded article in accordance with claim 7, wherein said pretreatment for coating is phosphating.

12. The pretreatment method for coating on a metal molded article in accordance with claim 7, wherein said pretreatment for coating is phosphating, and the composition of said treatment solution stored in said treatment bath is prepared from 0.5 to 2.5 g/l of zinc ion, 0.1 to 3 g/l of manganese ion, 5 to 40 g/l of phosphate ion, 0.05 to 3 g/l of a fluorine compound as HF, and at least one chemical conversion accelerator selected from 0.01 to 0.5 g/l of nitrite ion, 0.5 to 10 g/l of hydrogen peroxide, and 0.05 to 5 g/l of nitrobenzenesulfonate ion.

13. A pretreatment method for coating on a molded metal article having a substantially horizontal surface comprising the steps of:

dipping said molded metal article in a solution in a treatment bath; and agitating said solution around said horizontal surface of said molded metal article dipped in said solution in said treatment bath, by vibration of a plurality of vibrating plates of vibration agitation means provided in said inlet part, so that mean acceleration a expressed in the following equation is at least 8 cm/sec$^2$:

$$a = \sqrt{X^2 + Y^2 + Z^2}$$

where X, Y and Z, which are in units of cm/sec$^2$, represent average acceleration values of flow rate changes within 60 seconds, measured simultaneously in three axial directions of X, Y and Z which are perpendicular to each other at a measuring position.

* * * * *